US010315745B2

(12) United States Patent
Malcolm

(10) Patent No.: US 10,315,745 B2
(45) Date of Patent: Jun. 11, 2019

(54) INTEGRATED VARIABLE STIFFNESS MEMBER

(71) Applicant: Roger J. Malcolm, San Clemente, CA (US)

(72) Inventor: Roger J. Malcolm, San Clemente, CA (US)

( * ) Notice: Subject to any disclaimer, the term of this patent is extended or adjusted under 35 U.S.C. 154(b) by 0 days.

(21) Appl. No.: 15/675,515

(22) Filed: Aug. 11, 2017

(65) Prior Publication Data

US 2019/0047671 A1 Feb. 14, 2019

(51) Int. Cl.

| | |
|---|---|
| ***B63H 9/06*** | (2006.01) |
| ***B63H 9/04*** | (2006.01) |
| *B63H 9/08* | (2006.01) |

(52) U.S. Cl.

CPC ..... *B63H 9/0642* (2013.01); *B63H 9/04* (2013.01); *B63H 2009/065* (2013.01); *B63H 2009/086* (2013.01)

(58) Field of Classification Search

CPC ... B63H 9/00; B63H 9/04; B63H 9/06; B63H 9/0642

USPC ..... 114/102.24, 102.27

See application file for complete search history.

(56) References Cited

U.S. PATENT DOCUMENTS

| | | | | |
|---|---|---|---|---|
| 2,608,172 | A * | 8/1952 | Biuw | B63H 9/0642 114/102.27 |
| 3,905,321 | A * | 9/1975 | Blythe, Jr. | B63H 9/0642 114/102.27 |
| 4,136,630 | A | 1/1979 | Fraser | |
| 4,487,146 | A | 12/1984 | Parmentier | |
| 5,056,449 | A | 10/1991 | Howlett | |
| 5,413,060 | A | 5/1995 | Quigley | |
| 2013/0267394 | A1 * | 10/2013 | Duke | A63B 21/0608 482/110 |
| 2016/0221656 | A1 * | 8/2016 | Dogliotti | B63H 9/0642 |

* cited by examiner

*Primary Examiner* — Lars A Olson

(74) *Attorney, Agent, or Firm* — Charmasson, Buchaca & Leach, LLP

(57) ABSTRACT

An oblong stiffening member such as a sail batten having a tapered geometry formed by a pair of parallelly spaced apart oblique circular cones interconnected by a webbing strip. The member can be made from a unitary piece of fiber composite material such as a carbon fiber infused polymer wherein the orientations of the fibers are varied to provide both bending and torsional strength and stiffness that varies along the length of the member. Such properties can be useful in sail battens due to the rigorous dynamical forces subjected to such structures.

19 Claims, 5 Drawing Sheets

INTEGRATED VARIABLE STIFFNESS MEMBER

FIELD OF THE INVENTION

This invention relates to selectively and preferentially rigidizing structural members made from fiber composite materials and more particularly to carbon fiber composite sail battens.

BACKGROUND

Composite materials such as carbon fiber reinforced polymers have long been used to create structural elements due to their low weight and high stiffness/strength to bending moments along the oblong fibers' orientation.

U.S. Pat. No. 5,413,060 to Quigley, incorporated herein by reference, describes using a fiber reinforced composite material to make a sail batten. The cross-sectional geometry of the batten changes from the proximal end of the batten located near the mast to the opposite distal end near the trailing edge of the sail in order to adjust the stiffness of the batten along its longitudinal length.

One problem with such prior battens is that although they may provide a superior response to dynamical longitudinal bending moments, they may not exhibit adequate strength and stiffness to dynamical torsional moments. This can be a problem when the cross-section of the batten is not angularly uniform and when the batten loosely engages the pocket in the sail. Relatively loose engagement is preferred in order to easily insert and remove the batten from the pocket. Further, due to unpredictabilities and inaccuracies in the shape of the pocket, often caused by lack of precision in manufacturing, and caused by wear on the sail, the batten may be subjected to various unplanned bending and torsional loads.

Therefore, there is a need for an apparatus which addresses one or more of the above identified inadequacies.

SUMMARY

The principal and secondary objects of the invention are to provide an improved fiber reinforced composite structural member. These and other objects can be achieved by a pair of substantially parallel, spaced-apart tapering rods laterally joined by a substantially planar webbing strip.

In some embodiments there is provided an oblong stiffening member such as a sail batten having a tapered geometry to provide variable stiffness along its length. In some embodiments the member can be made from fiber composite materials such as carbon fiber embedded epoxy resin wherein the orientations of the fibers are varied to provide both bending and torsional strength and stiffness that varies along the length of the member.

In some embodiments there is provided an improved variable stiffness structural member comprises: a pair of substantially parallel, oblong, spaced-apart rods, laterally joined by a webbing strip; wherein each of said rods has a variable cross-sectional geometry along a length of said member.

In some embodiments said member further comprises: a proximal end and a distal end; said member having a first cross-sectional area near said proximal end and a second cross-sectional area near said distal end; wherein said first cross-sectional area is larger than said second cross-sectional area.

In some embodiments each of said pair of rods gradually tapers from said proximal end toward said distal end.

In some embodiments said first one of said pair of rods comprises an axial hollow.

In some embodiments said axial hollow has a substantially conical shape.

In some embodiments said rods have a substantially conical shape.

In some embodiments said rods have a substantially oblique circular conical shape.

In some embodiments both of said pair of rods are similarly shaped and dimensioned.

In some embodiments said first cross-sectional area is substantially barbell shaped.

In some embodiments said first cross-sectional area comprises a pair of spaced apart, interconnected, diametrically symmetric geometric shapes.

In some embodiments said shapes are selected from the group consisting of: circles, ellipses, triangles, squares, rectangles, trapezoids, pentagons, hexagons, heptagons, octagons, nonagons, and decagons.

In some embodiments said first cross-sectional area has a width dimension corresponding to said webbing strip, and a height dimension corresponding to an outer diameter of said one of said rods, and wherein said width dimension is equal to or greater than said diameter dimension.

In some embodiments said member further comprises having a first width dimension at said proximal end and a second width dimension at said distal end.

In some embodiments said first width dimension is equal to or greater than said second width dimension.

In some embodiments said member is formed by a unitary piece of composite material.

In some embodiments said member further comprises fiber reinforced material having a first fiber orientation and a second fiber orientation.

In some embodiments said first orientation is rotated substantially 90 degrees with respect to said second fiber orientation.

In some embodiments said member further comprises fiber reinforced material having a third fiber orientation rotated substantially 45 degrees with respect to said second fiber orientation.

In some embodiments said member further comprises: a plural number of discrete zones wherein a first of said zones includes a first set of plural fiber orientations, and a second of said zones includes a second set of plural fiber orientations different from said first set of plural fiber orientations.

In some embodiments there is provided the combination of a sailing craft having a sail and a plurality of sail battens, wherein at least one of said battens comprises: a fiber reinforced composite structural member which comprises: a pair of substantially parallel, spaced-apart tapering rods, laterally joined by a webbing strip.

The original text of the original claims is incorporated herein by reference as describing features in some embodiments.

DESCRIPTION OF THE EXEMPLARY EMBODIMENTS

Figure 1:
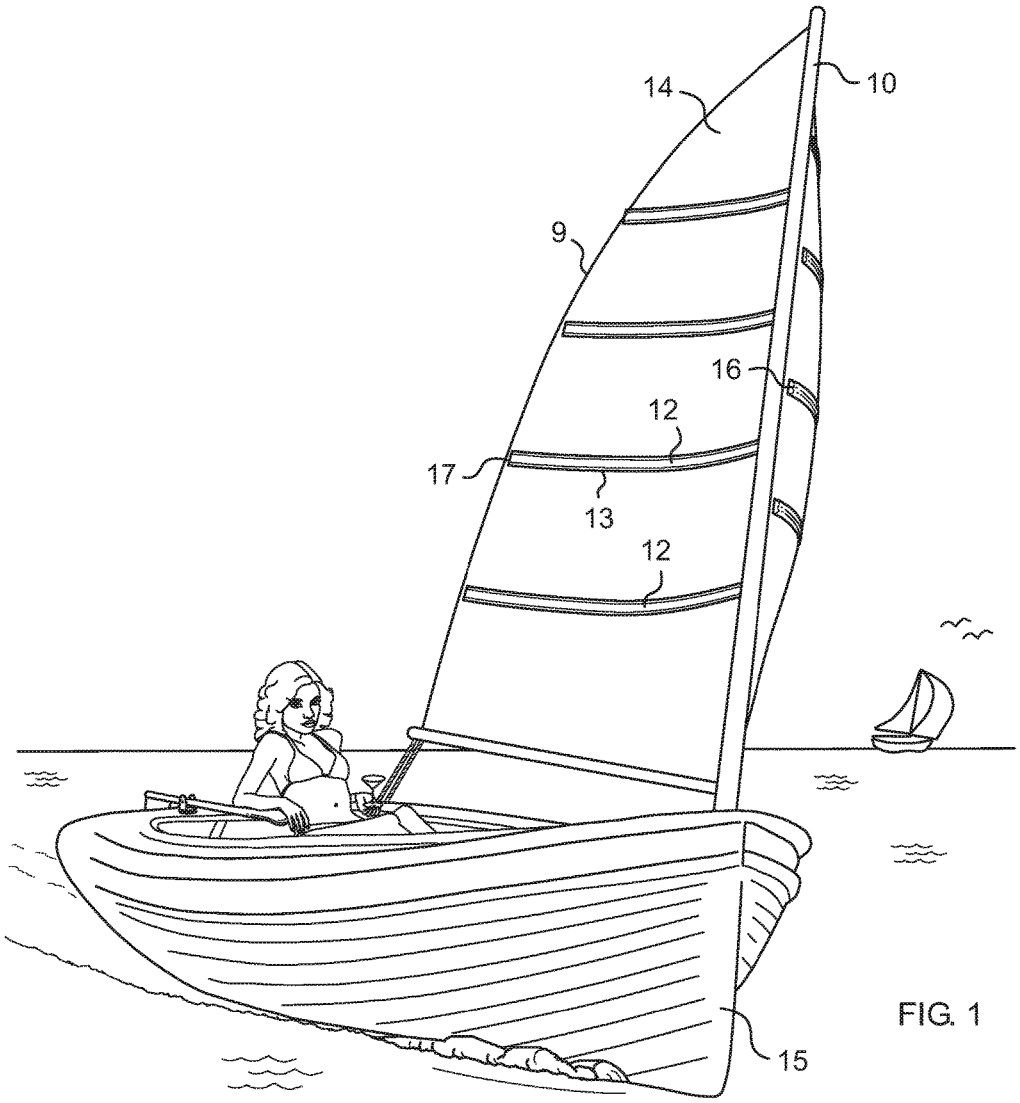
FIG. 1 is a diagrammatic perspective view of an improved fiber reinforced composite structural member used as a sail batten on a sailing vessel.
Figure 2:
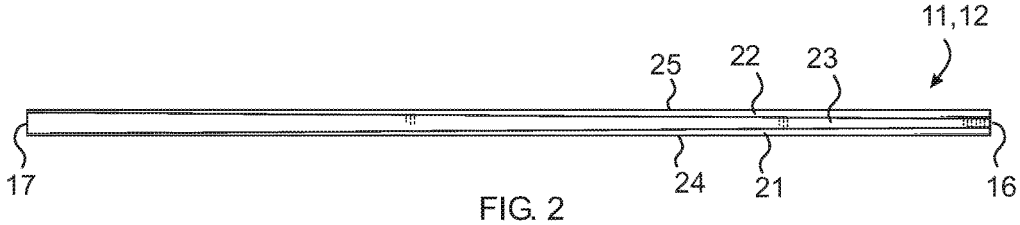
FIG. 2 is a diagrammatic front view of a fiber reinforced composite structural member according to an exemplary embodiment of the invention.
Figure 3:
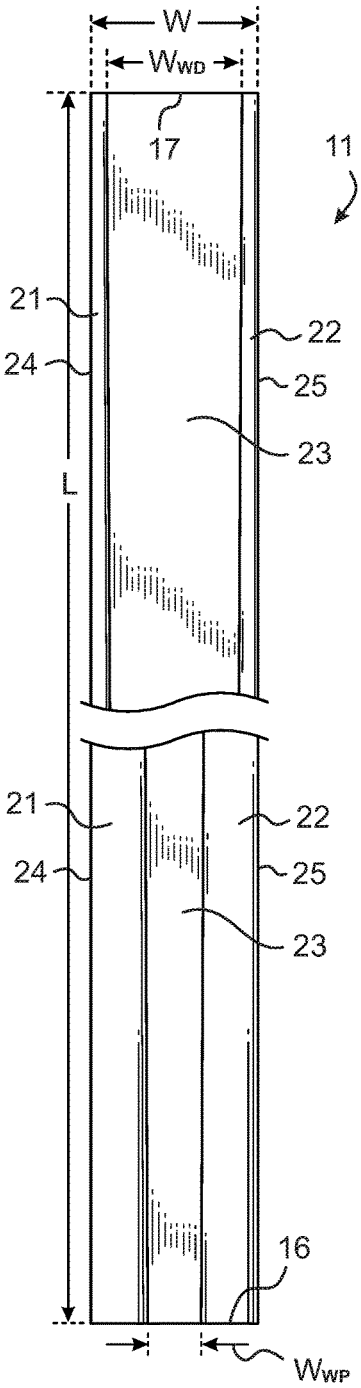
FIG. 3 is a diagrammatic partial elevational front view thereof.
Figure 4:
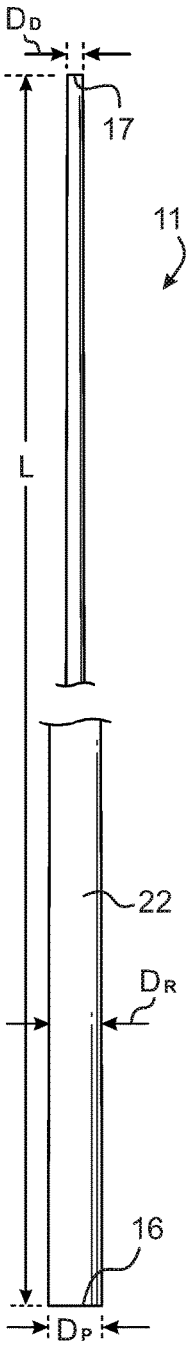
FIG. 4 is a diagrammatic partial elevational side view thereof.
Figure 5:
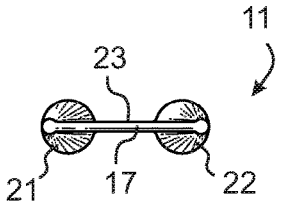
FIG. 5 is a diagrammatic distal end view thereof.
Figure 6:
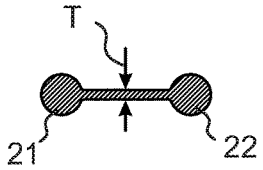
FIG. 6 is a diagrammatic cross-sectional end view taken along a medial section thereof.

Referring now to the drawing, there is shown in FIG. 1 a multidimensionally reinforced fiber composite lightweight stiffening member 11 according to an exemplary embodiment of the invention as implemented on a batten 12 carried within a transverse pocket 13 of a sail 14 of a sailing vessel 15 where the batten urges the sail into a more optimum aerodynamic shape. FIG. 2 shows the member 11 removed from the sail and laid flat. The member has an oblong, substantially rectangular shape extending from a proximal end 16 or base, to be located near the mast 10 of the sailing vessel, to an opposite distal end 17, to be located near the trailing edge 9 of the sail.

Referring now to FIGS. 2-7, the member 11 includes a pair of parallelly spaced apart, solid rods 21,22 forming the opposite lateral edges 24,25 of the member and extending along substantially the entire longitudinal length L of the member from the proximal end 16 to the distal end 17. Each of the rods can have a substantially conical shape having a substantially circular cross-section where the diameter Dr varies according to its longitudinal position on the member, gently and gradually tapering from a wider proximal diameter Dp to a narrower distal diameter Dd. The substantially conical shape can be characterized by a ratio between these two diameters Dd/Dp which ranges from between about 0.05 to 0.5. The conical shape can be an oblique circular cone so that cross-sections perpendicular to the elongation axis of the member form circles. Alternately, the conical shape can be a right circular cone where cross-sections perpendicular to the elongation axis of the member form ellipses, albeit ones with very low eccentricity.

The rods 21,22 are interconnected by a medial webbing strip 23 having generally parallel trapezoidal front and back surfaces. Thus, the webbing strip can be substantially planar, having a substantially uniform thickness T along the entire longitudinal length of the member.

The rods can be angled outwardly so that the lateral extent of the member remains substantially uniform. In other words, the overall width W of the member can remain constant. This also causes the width of the webbing strip Ww to vary between a narrower width at the proximal end of the member to a wider width at the distal end of the member. Thus the width of the member can be defined as W=Ww+2(Dr).

Figure 7:
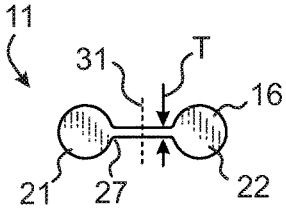
FIG. 7 is a diagrammatic proximal end view thereof.
Figure 8:
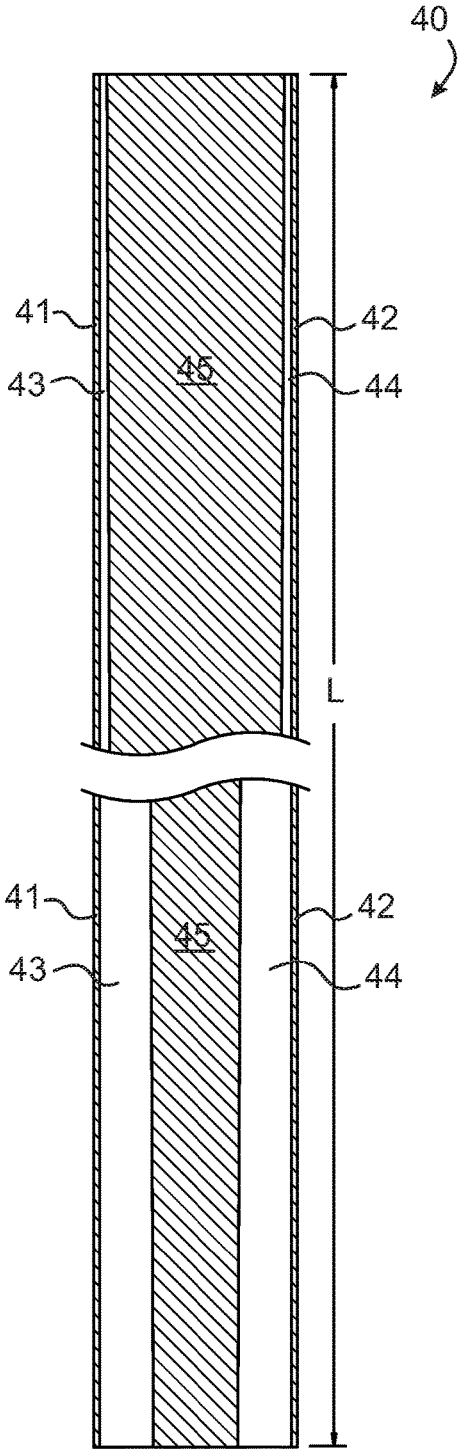
FIG. 8 is a diagrammatic partial, cross-sectional front view of a fiber reinforced composite structural member having rod lumens according to an alternate exemplary embodiment of the invention.
Figure 9:
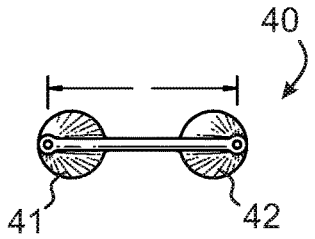
FIG. 9 is a diagrammatic distal end view of the member of FIG. 8.
Figure 10:
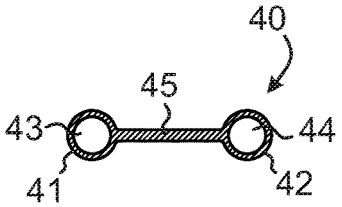
FIG. 10 is a diagrammatic cross-sectional end view taken along a medial section of the member of FIG. 8.
Figure 11:
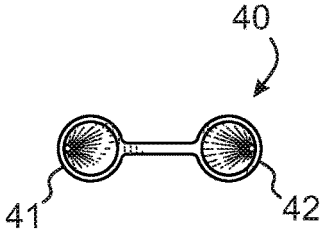
FIG. 11 is a diagrammatic proximal end view of the member of FIG. 8.

Referring now to FIG. 7, by making both rods 21,22 substantially identically shaped and dimensioned, the member 11 can be made to be symmetric about a plane 31 perpendicularly bisecting the webbing strip 23. In this way, the symmetrical member can be conveniently loaded in the pocket without regard to whether which rod is located on the top side. It shall be noted that the transition between each rod and webbing strip can be gradual in the form of a concave fillet 27 having a radius of between approximately 5% to 25% of the cross-sectional diameter of the rod at the point of contact with the fillet. Although the member is shown having a barbell shaped cross-section where the rods form a pair of circles, other shapes are available, such as for example, ellipses, rounded squares, rectangles ovals, or other polygons having rounded vertices.

Referring now to FIGS. 8-11, the member 40 can be further adapted so that the rods 41,42 are hollow, each having a central lumen 43,44 extending the length of the respective rod. The medial webbing strip 45 interconnecting the rods can remain solid. The shape and dimensioning of the lumen can be selected so that the wall formed between the outer surface of the rod and the inner surface facing the lumen is ring-shaped having a circular outer surface cross-section and a circular inner surface cross-section. The wall thickness can thus be angularly uniform at every cross-section and linearly uniform from end to end. The lumen can terminate in apertures at the distal and proximal ends. Alternately, the lumens can terminate in a closed cup at the distal extremity of the lumen. The lumens can serve to reduce the mass and amount of material contained in the member while maintaining adequate bending and torsional stiffness and strength.

The stiffness properties of the member can be adjusted by forming the member from fiber-resin composite materials such as a carbon-fiber epoxy resin composite. The uncured epoxy is combined with carbon fibers using techniques well known in the art. In this example a thermosetting preimpregnated resin tape or "prepreg" is used such as unidirectional fiber tape available from American Cyanamid Co. of Wayne, N.J. Layers of the tape are successively wrapped onto one another to form into an uncured member body corresponding to the desired size of the sail batten. Once cured the body becomes the unitary fiber composite member.

The orientation of the fibers can be selected to enhance stiffness with respect to bending moments apart from the elongation direction of the member.

Figure 12:
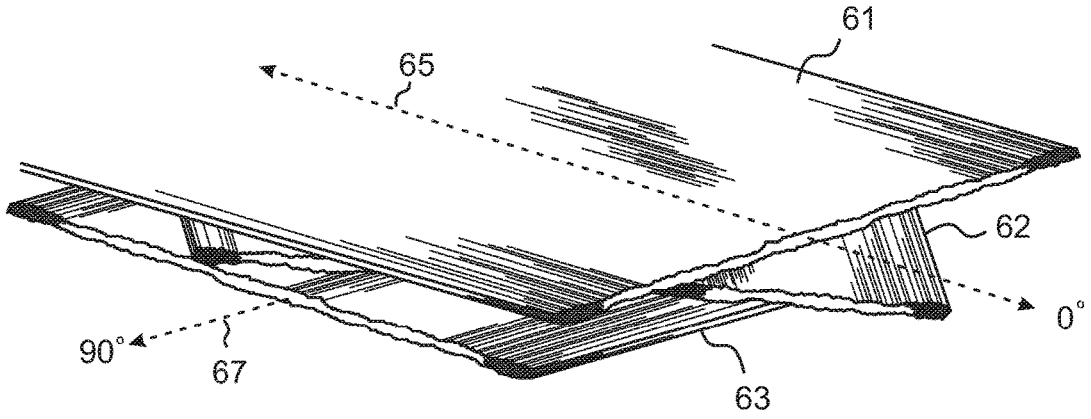
FIG. 12 is a diagrammatic partial perspective view of fiber composite layers having differential orientations.
Figure 13:
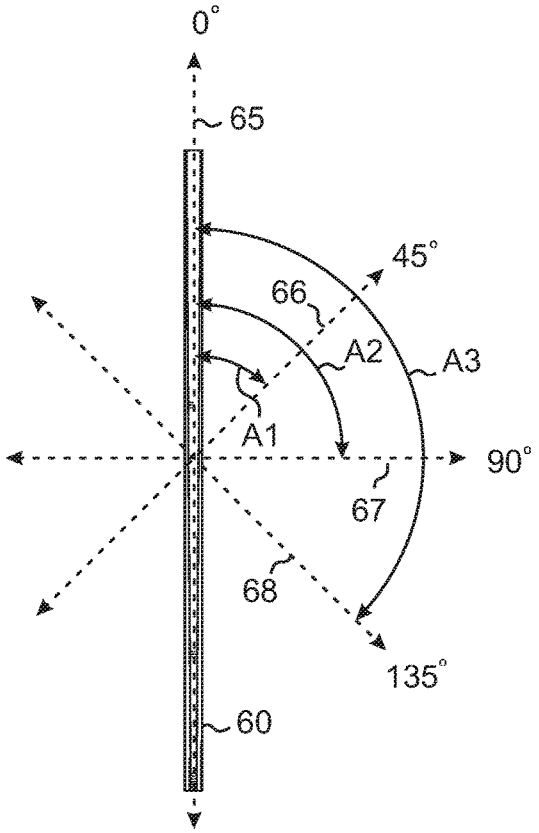
FIG. 13 is a diagrammatic top view of a fiber composite member showing the variously selected fiber orientations.

As shown diagrammatically in FIGS. 12 and 13, successive layers 61,62,63 of tape can be applied where the direction of fibers in each layer are different from the direction of fibers in each successive layer to adjust stiffness properties to forces applied from various directions and magnitudes over time. For example, a first layer 61, can be oriented at 0 degrees so that the elongation direction of the embedded fibers are parallel with the elongation axis 65 of the member 60. A second layer 62, can be oriented so that the elongation direction 66 of the embedded fibers are at an angle A1 of about 45 degrees with respect to the elongation axis of the member. Similarly, a third layer 63, can be oriented so that the elongation direction 67 of the embedded fibers are at an angle A2 of about 90 degrees with respect to the elongation axis of the member. A fourth layer, can be oriented so that the elongation direction 68 of the embedded fibers are at an angle A3 of about 135 degrees with respect to the elongation axis of the member.

Figure 14:
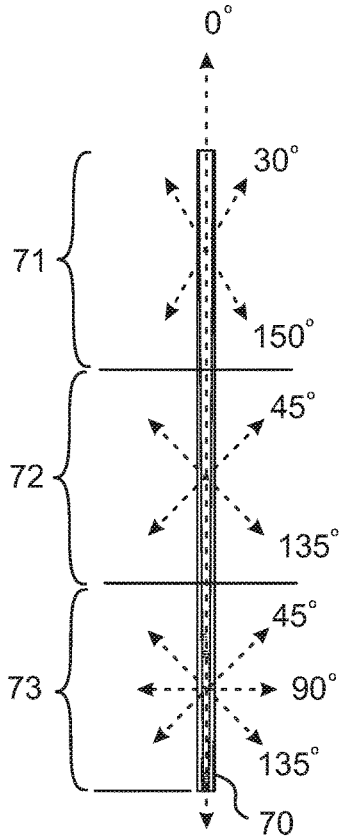
FIG. 14 is a diagrammatic top view of a fiber composite member showing plural zones of variously selected fiber orientations.

Referring now to FIG. 14, the structural member can be divided into a plural number of zones where the fiber orientation of the various layers within the zone can be different from the orientations on other zones in order to selectively and preferentially rigidize the different zones of the member differently. By way of example, the member 70 can be divided longitudinally into three discrete zones 71,72,73 where the first distal zone 71 can have a set of fiber layers oriented in the 0 degree direction and in the 30 degree and 150 degree directions. A second medial zone 72 can have a set of fiber layers oriented in the 0 degree direction and in the 45 degree and 135 degree directions. A third proximal zone 73 can have a set of fiber layers oriented in the 0 degree direction and in the 45 degree, 90 degree, and 135 degree directions. Thus, the set of fiber layers in a particular zone results in that set having a plural number of different fiber orientations. Further, plural fiber orientations of one set are different from the plural fiber orientations of another set. These differential fiber orientation sets combined over the length of the member will preferentially rigidize the proximal zone to greater bending and torsional loads than the distal zone.

Figure 15:
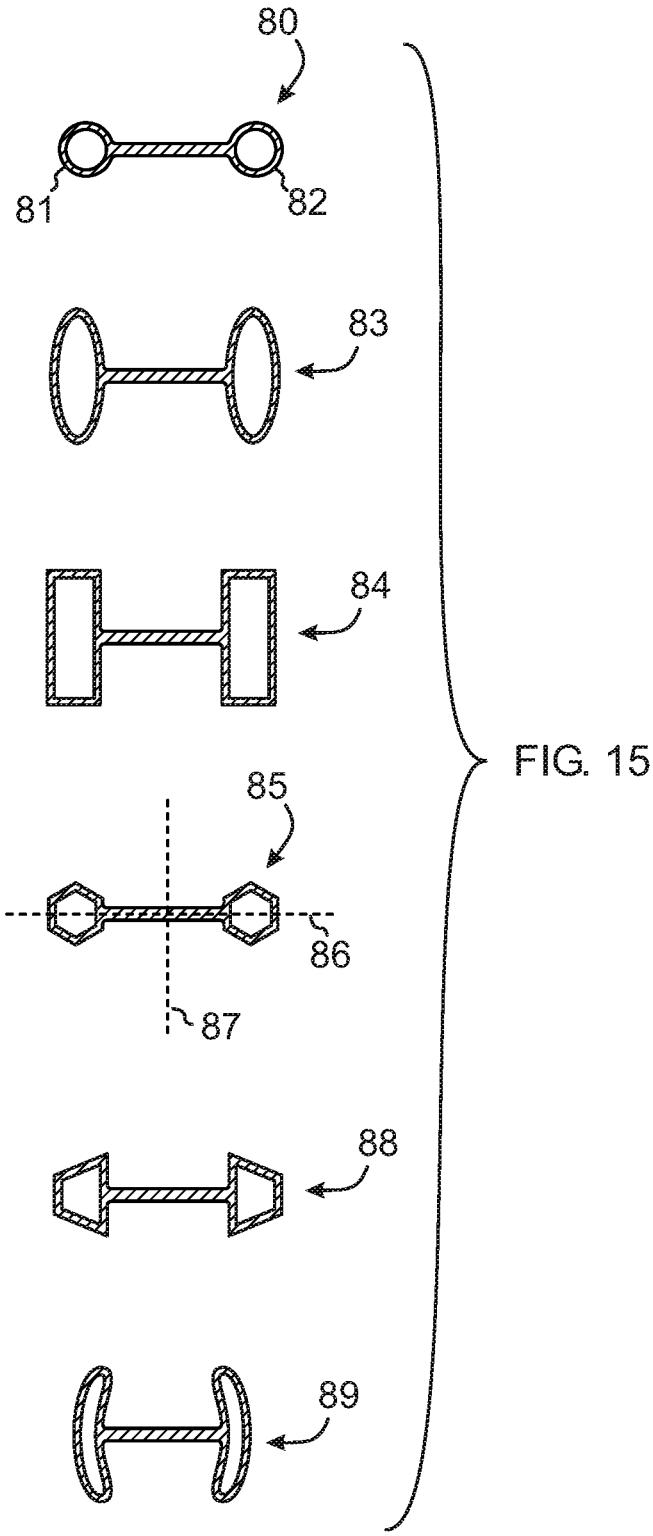
FIG. 15 is a diagrammatic cross-sectional views of various rod geometries.

Referring now to FIG. 15, as previously shown, the cross-sectional shape of the member 80 can include rods 81,82 having a substantially circular shape. However, other shapes may be useful for other structural members depending on the application for which the members are used, and due to manufacturing concerns. For example, the rods can have an elliptical shape 83, or a quadrangular shape, including squares and rectangles 84. Rods having other diametrically symmetrical polygonal shapes such as hexagons 85, octagons, and decagons can be used to provide a member cross section which is symmetric about the side-to-side transverse axis 86, and the front-to-back transverse axis 88. Other shapes can be used which are diametrically symmetric depending on orientation such as trapezoids 88, pentagons, and heptagons. Myriad other more complex shapes which provide symmetricity with respect to both transverse axes are available such as substantially half-moon shapes 89. For sail batten applications such symmetricity is preferred in order to ease installation of the battens in the sails. However, non-symmetric rod cross-sections can be used depending on the application.

The above-described members can provide bending stiffness as a function of distance from the proximal end of the member according to the geometry of the lateral rods, fiber orientation within the various zones of the member, and the thickness of the interconnecting webbing strip.

It has been found that the properties exhibited by the above described structural member can be useful in sail battens due to the rigorous dynamical moments subjected to such structures and the variable stiffness of the member along its length.

While the preferred embodiments of the invention have been described, modifications can be made and other embodiments may be devised without departing from the spirit of the invention and the scope of the appended claims.

What is claimed is:

1. An improved variable stiffness structural member comprises:

a pair of substantially parallel, oblong, spaced-apart rods, laterally joined by a webbing strip;

wherein each of said rods has a variable cross-sectional geometry along a length of said member; and, wherein said member further comprises fiber reinforced material having a plural number of discrete zones wherein a first of said zones includes a first set of plural fiber orientations, and a second of said zones includes a second set of plural fiber orientations different from said first set of plural fiber orientations.

2. The member of claim 1, wherein said member further comprises:

a proximal end and a distal end;

said member having a first cross-sectional area near said proximal end and a second cross-sectional area near said distal end;

wherein said first cross-sectional area is larger than said second cross-sectional area.

3. The member of claim 2, wherein each of said pair of rods gradually tapers from said proximal end toward said distal end.

4. An improved variable stiffness structural member comprises:

a pair of substantially parallel, oblong, spaced-apart rods, laterally joined by a webbing strip;

wherein each of said rods has a variable cross-sectional geometry along a length of said member;

wherein said member further comprises:

a proximal end and a distal end;

said member having a first cross-sectional area near said proximal end and a second cross-sectional area near said distal end;

wherein said first cross-sectional area is larger than said second cross-sectional area;

wherein each of said pair of rods gradually tapers from said proximal end toward said distal end; and, wherein said first one of said pair of rods comprises an axial hollow.

5. The member of claim 4, wherein said axial hollow has a substantially conical shape.

6. The member of claim 1, wherein said rods have a substantially conical shape.

7. An improved variable stiffness structural member comprises:

a pair of substantially parallel, oblong, spaced-apart rods, laterally joined by a webbing strip;

wherein each of said rods has a variable cross-sectional geometry along a length of said member;

wherein said rods have a substantially conical shape; and, wherein said rods have a substantially oblique circular conical shape.

8. The member of claim 1, wherein both of said pair of rods are similarly shaped and dimensioned.

9. An improved variable stiffness structural member comprises:

a pair of substantially parallel, oblong, spaced-apart rods, laterally joined by a webbing strip;

wherein each of said rods has a variable cross-sectional geometry along a length of said member;

wherein said member further comprises:

a proximal end and a distal end;

said member having a first cross-sectional area near said proximal end and a second cross-sectional area near said distal end;

wherein said first cross-sectional area is larger than said second cross-sectional area; and, wherein said first cross-sectional area is substantially barbell shaped.

10. The member of claim 2, wherein said first cross-sectional area comprises a pair of spaced apart, interconnected, diametrically symmetric geometric shapes.

11. The member of claim 10, wherein said shapes are selected from the group consisting of:

circles, ellipses, triangles, squares, rectangles, trapezoids, pentagons, hexagons, heptagons, octagons, nonagons, and decagons.

12. An improved variable stiffness structural member comprises:

a pair of substantially parallel, oblong, spaced-apart rods, laterally joined by a webbing strip;

wherein each of said rods has a variable cross-sectional geometry along a length of said member;

wherein said member further comprises:

a proximal end and a distal end;

said member having a first cross-sectional area near said proximal end and a second cross-sectional area near said distal end;

wherein said first cross-sectional area is larger than said second cross-sectional area; and, wherein said first cross-sectional area has a width dimension corresponding to said webbing strip, and a height dimension corresponding to an outer diameter of said one of said rods, and wherein said width dimension is equal to or greater than said diameter dimension.

13. The member of claim 1, wherein said member further comprises having a first width dimension at said proximal end and a second width dimension at said distal end.

14. The member of claim 13, wherein said first width dimension is equal to or greater than said second width dimension.

15. The member of claim 1, wherein said member is formed by a unitary piece of composite material.

16. The member of claim 12, wherein said member further comprises fiber reinforced material having a first fiber orientation and a second fiber orientation.

17. The member of claim 1, wherein said first orientation is rotated substantially 90 degrees with respect to said second fiber orientation.

18. An improved variable stiffness structural member comprises:

a pair of substantially parallel, oblong, spaced-apart rods, laterally joined by a webbing strip;

wherein each of said rods has a variable cross-sectional geometry along a length of said member;

wherein said member further comprises fiber reinforced material having a first fiber orientation and a second fiber orientation;

wherein said first orientation is rotated substantially 90 degrees with respect to said second fiber orientation; and, wherein said member further comprises fiber reinforced material having a third fiber orientation rotated substantially 45 degrees with respect to said second fiber orientation.

19. The combination of a sailing craft having a sail and a plurality of sail battens, wherein at least one of said battens comprises:

a fiber reinforced composite structural member which comprises:

a pair of substantially parallel, spaced-apart tapering rods, laterally joined by a webbing strip; and, a plural number of discrete zones wherein a first of said zones includes a first set of plural fiber orientations, and a second of said zones includes a second set of plural fiber orientations different from said first set of plural fiber orientations.

* * * * *